US005433429A

United States Patent [19]

Muller

[11] Patent Number: 5,433,429

[45] Date of Patent: Jul. 18, 1995

[54] METHOD AND APPARATUS FOR THE EXACT SEPARATION OF MAIN AND AUXILIARY STACKS IN NON-STOP DELIVERIES OF SHEET-PROCESSING PRINTING MACHINES

[75] Inventor: Joachim Muller, Eppertshausen, Germany

[73] Assignee: MAN Roland Druckmaschinen AG, Germany

[21] Appl. No.: 248,749

[22] Filed: May 25, 1994

[30] Foreign Application Priority Data

May 25, 1993 [DE] Germany ..... 43 17 357.8

[51] Int. Cl.[6] ..... B65H 31/12

[52] U.S. Cl. ..... 271/189; 271/218; 414/790.8

[58] Field of Search ..... 271/213, 217, 218, 189; 414/790.8

[56] References Cited

U.S. PATENT DOCUMENTS

| | | | |
|---|---|---|---|
| 2,836,418 | 5/1958 | Blattner et al. | 271/189 |
| 5,002,456 | 3/1991 | Gosslinghoff | 271/218 |
| 5,110,112 | 5/1992 | Henn et al. | 271/218 |
| 5,131,647 | 7/1992 | Henn et al. | 271/218 |
| 5,322,272 | 6/1994 | Betz et al. | 271/218 |

FOREIGN PATENT DOCUMENTS

| | | | |
|---|---|---|---|
| 921941 | 1/1955 | Germany . | |
| 2301840A1 | 7/1974 | Germany . | |
| 2525422A1 | 12/1976 | Germany . | |
| 3112558C2 | 2/1983 | Germany . | |
| 3112672C1 | 6/1983 | Germany . | |
| 3937945C2 | 9/1991 | Germany . | |
| 4011286A1 | 10/1991 | Germany . | |
| 4021676C1 | 11/1991 | Germany . | |
| 7509635 | 11/1976 | Netherlands | 271/218 |

*Primary Examiner*—H. Grant Skaggs

*Attorney, Agent, or Firm*—Leydig, Voit & Mayer, Ltd.

[57] ABSTRACT

An apparatus for auxiliary stack formation in a sheet-delivery machine having front and rear stationary stops and a front sheet-retaining device a stack board for receiving sheets, and being moveable rearwardly in a gap above the main stack, the stack board receiving the sheets forming the auxiliary stack, a set of spaced-apart lower rear stops mounted on a horizontally disposed carrier, the carrier being vertically moveable relative to the stationary rear upper stops, between a lower position wherein the lower stops extend beneath the main stack and a upper position wherein the lower stops are above the main stack for preventing rearward movement of the auxiliary stack sheets; wedge members mounted on the carrier, engageable by the advancing stack board for moving the carrier between the lower and upper positions; and a plurality of rear sheet retention devices disposed horizontally in spaced-apart relation and mounted on the carrier for movement between a recessed position behind the rear stops, and a sheet retention position for receiving the rear edges of the auxiliary sheets, the rear sheet retention devices being mounted for combined horizontal and vertical movement between the positions as the carrier moves between the lower and upper positions.

8 Claims, 2 Drawing Sheets

METHOD AND APPARATUS FOR THE EXACT SEPARATION OF MAIN AND AUXILIARY STACKS IN NON-STOP DELIVERIES OF SHEET-PROCESSING PRINTING MACHINES

FIELD OF THE INVENTION

The present invention relates generally to a method and apparatus for the separation of main and auxiliary stacks in non-stop deliveries in sheet-processing printing machines, or the like, and more particularly concerns the exact stack delivery of stacks incident to the non-stop delivery of sheets.

BACKGROUND OF THE INVENTION

The sheet delivery mechanisms in printing machines typically possess front and rear sheet stops for the alignment of the sheets to be deposited and a push-in auxiliary-stack board or rake for intercepting sheets during the stack change. DE 2,301,840 A1 discloses a sheet-delivery apparatus, in which, in the region of the front edge of the sheet to be deposited, bearing fingers can be pivoted inwards over the main stack. In a further design, for the purpose of the stack change, an auxiliary-stack table can be pushed in over the main stack and sheet retention devices, which are arranged on the side located opposite the bearing fingers, can be introduced above the stack by means of working cylinders.

An apparatus for the intermediate interception of sheets, particularly for holding the sheet rear edge, is know from DE 3,112,558 C2. As disclosed there, angle supports are arranged rotatably on a holder in the region of the sheet brake and serve as supporting means for the sheet rear edge. The angle supports have different leg lengths and can swing away as a result of the weight of the sheets, when a plurality of sheets are laid on them, so that the part stack obtained passes onto the intermediate-stack board, which in the meantime has been pushed in.

DE 3,112,672 C1 discloses a stop for the sheet rear edge, which is designed as a crossmember and which, together with supporting shears fastened to the sheet brake, is arranged so as to be movable up and down in conjunction with an intermediate-stack device.

DE 3,937,945 C2 discloses a sheet rear-edge catching device for deliveries having a non-stop auxiliary-stack device. Controllable catching fingers are arranged underneath the suction roller between rear-edge stops and are movable jointly in one plane by a pneumatic working cylinder operating a rack and pinion.

In the abovementioned references DE 2,301,840 A1 and DE 3,112,558 C2, it is impossible to prevent oncoming sheets from slipping back into the machine in the direction of the sheet feed, or from being jammed or deformed between the rear-edge stop and auxiliary stack.

According to DE 3,112,672 C1, the oncoming sheets are prevented from slipping back, but the stop cannot achieve the object of an exact separation of the sheets of the main and auxiliary stacks.

According to DE 3,937,945 C2, the oncoming sheets are prevented from slipping back, but, a complicated design for the separation of the main and auxiliary stacks is necessary. Actions in which sheets are speared in the region of the rear edge are avoided during the pushing in of the rake, but the risk is merely transferred to the horizontal reciprocating movement of the catching fingers. Particularly at higher machine speeds (for example, four sheets per second), spearing actions by the catching fingers are unavoidable.

As a further development of DE 3,937,945 C2, a device, is described in DE 4,011,286 A1 wherein the catching fingers are designed as suction grippers. On the top side of the suction grippers, the deposited sheets are sucked up by means of suction nozzles, and in order to tension the sheets the suction grippers are retracted by a specific amount. The suction grippers move horizontally, in a similar way to DE 3,937,945 C2, and do not overcome the disadvantages already indicated.

SUMMARY OF THE INVENTION

The primary aim of the invention is to provide for exact separation of the sheets of the main and auxiliary stacks while substantially minimizing the disadvantages mentioned, particularly prevention of the oncoming sheets forming the auxiliary stack slipping into the machine in the feed direction.

The solution according to the invention guarantees non-stop operation at a maximum machine speed. For example, at a speed a four sheets per second, the main stack is moved out during the production run without interruption of sheet delivery. This increases the effective capacity of the printing machine and has a positive effect on the printing quality, since disturbances in the ink/dampening-medium balance are avoided and, for the stack change, the speed of the printing machine does not have to be reduced during the production run. The sheet delivery of the invention is equipped with a lowerable auxiliary stack and with a separating apparatus including rear sheet retention devices adjacent the rear sheet stop for the exact automatic separation of the main and auxiliary stacks during the push-in of the rake or stack board.

In the illustrated device, the main and auxiliary stacks have separate drives which, via four roller chains, raise or lower the steel plate or steel frame fastened to them. Conventional angle rails are arranged laterally and pivot laterally inward and outward to, respectively, confine the stack board to a horizontal plane, and to allow it to leave that plane. The combination of stationary rear upper stops and vertically movable rear lower stops, guarantees that the oncoming sheets cannot slip back into the machine in the direction of sheet feeding.

Pursuant to the invention the rear lower stops are mounted on a horizontal carrier, which moves vertically in response to the advance of the stack board. The carrier is operatively connected to a vertically moveable cross member and a stationary cross bar. The carrier also carries mounting and guide means and rear sheet retention devices such that vertical movement of the carrier causes the rear sheet retention devices to move horizontally to a sheet retaining position, while also moving vertically. Thus by means of the vertical movement of the rear lower stops, the rear sheet retention devices are introduced into the stack during the push-in of the stack board or rake and separate the stack into main and auxiliary stacks.

In further keeping with the invention, because the sheets to be deposited are held at the rear edge above the pushed-in stack board/rake, the sheets cannot be displaced or deformed in the direction of sheet feeding during the pushing-in operation. The combined horizontal and vertical movement of the rear sheet retention devices ensures that a smooth stripping off of the last sheets of the uppermost layer of the main stack takes place and an exact separation between the main and auxiliary stacks is achieved without spearing actions by the sheet holding-up devices. The smooth stripping off is comparable to a "leafing through" of the sheet edges. The "leafing through" of the last sheets of the upper layer of the main stack, until the bottommost sheet of the newly forming auxiliary stack is reached, and the depositing of the bottommost sheet and of the subsequent sheets on the sheet holding-up devices while the sheet holding-up devices move to a level with the top side of the stack board, brings about an exact stack separation. Preferably during the last stage of formation of the auxiliary stack, the rear sheet holding-up devices reach a uniform level at the underside of the bottommost sheet of the auxiliary stack.

Further objects and advantageous will become apparent to one of skill in the art upon review of the following specification and attached drawings in which:

DETAILED DESCRIPTION OF THE PREFERRED EMBODIMENT

The invention will now be described in reference to a preferred embodiment. The invention, however, is not limited to this embodiment, and the invention includes all modifications and equivalents as fall within the scope of the invention as defined by the appended claim. Further, all references and publications referred to or cited in this application are hereby incorporated by reference.

Figure 1:
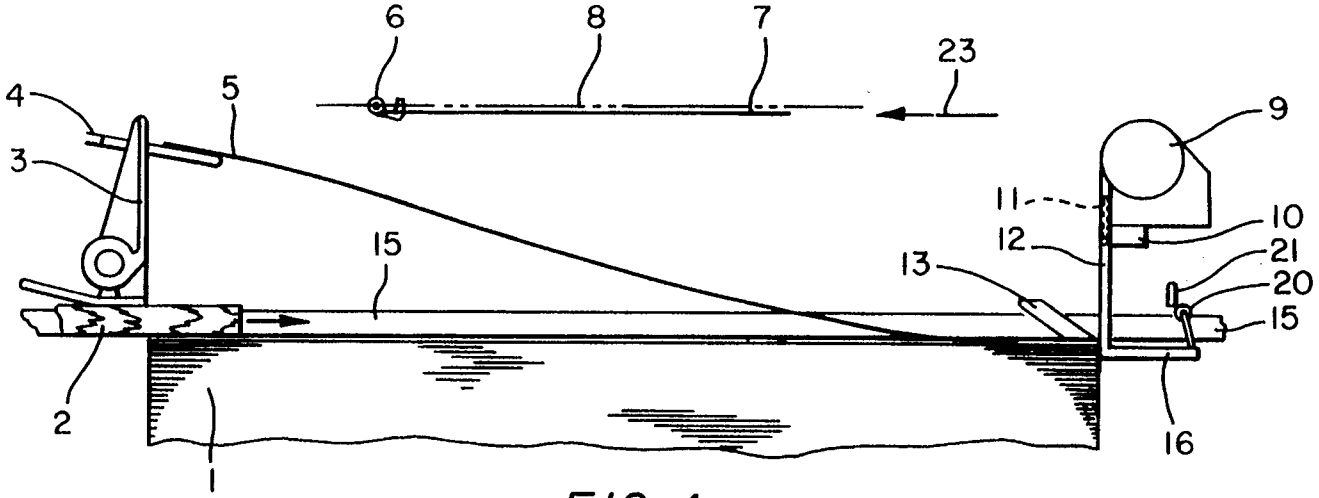
FIG. 1 shows a diagrammatic side view of a sheet delivery device including an auxiliary-stack forming apparatus according to the invention arranged for non-stop operation.

FIG. 1 illustrates a sheet 7 being conveyed by a sheet delivery device, associated with a sheet-fed printing press or the like. The sheet is fed in the conveying direction indicated by arrow 23 by means of a chain system 8 and a gripper device 6. The sheets 7 arriving from a printing machine are transported over a main stack 1 and are deposited thereon. Each sheet is deposited with the sheet front edge against front stops 3, which are arranged next to one another. Inwardly pivotable angle rails 15 for receiving a stack board 2 are arranged parallel to the side parts of the delivery device. For the purpose of the extraction of sample sheets or for forming an auxiliary stack 5, front sheet retention devices 4 of conventional design extend over the sheet width and are arranged for selective actuation to a retention position shown in FIG. 1.

Figure 2:
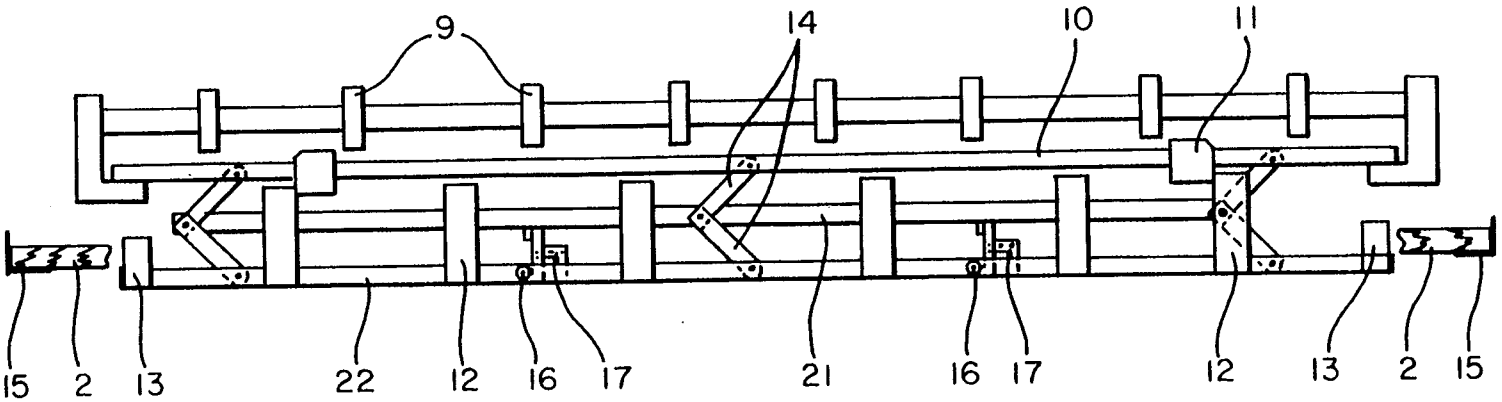
FIG. 2 shows a front view of the rear stack stop (viewed in the direction opposite to the sheet conveying direction)

In the region of the rear edge of the sheets 7 deposited to form a stack, a sheet-braking device 9 is adjustably disposed above the stack at a horizontal position in dependence on the particular sheet format. Underneath the sheet brake 9, a transversely extending cross member 10 is fastened to the sheet brake 9 as seen most clearly in FIG. 2. A plurality of upper stops 11 are disposed in spaced-apart relation to one another on the cross member 10 in parallel with the rear edge of the deposited sheet 7. The stops 11 extend vertically upwards toward the sheet-braking device 9. A cross bar 21 and a carrier 22 are arranged underneath the cross member 10. The cross member 10, cross bar 21 and carrier 22 are connected via a plurality of cranks 14, in such a way that the carrier 22 and cross bar 21 are movable vertically up and down relative to the stationary cross member 10. The cranks 14 also introduce lost motion into the vertical movement off carrier 22 and cross bar 21, such that upward motion of the carrier 22 causes upward motion of cross bar 21 at the upward end of that vertical movement. Similarly, downward movement of carrier 22 only causes movement of cross bar 21 when the carrier 22 is near the top of its travel. Thus vertical movement of carrier 22 causes movement of cross bar 21 only during terminal portions of that movement.

It will be understood, of course, that the carrier 22 is made wider than the maximum sheet width, but smaller than the distance between the two angle rails 15. In accordance with the present invention, a plurality of wedges 13 are fastened to the free ends of the carrier 22, and a plurality of lower stops 12 are arranged on the carrier 22 in spaced-apart relation to one another over the sheet width. Also pursuant to the invention, at least two of the lower stops 12 are guided together with the upper stops 11, to provide for relative movement (translation) of the lower stops 12 with respect to the stationary upper stops 11. In the illustrated embodiment, two upper stops 11 each possess, on one end face, a longitudinal groove **11*a* of specific length, in which a bolt 12*a* coupled to the associated lower stop 12 is guided. The arrangement of bolt 12*a* and groove 11*a* seen most clearly in FIG. 3. The lower stops extend downwards into the region of the main stack 1**.

Figure 3:
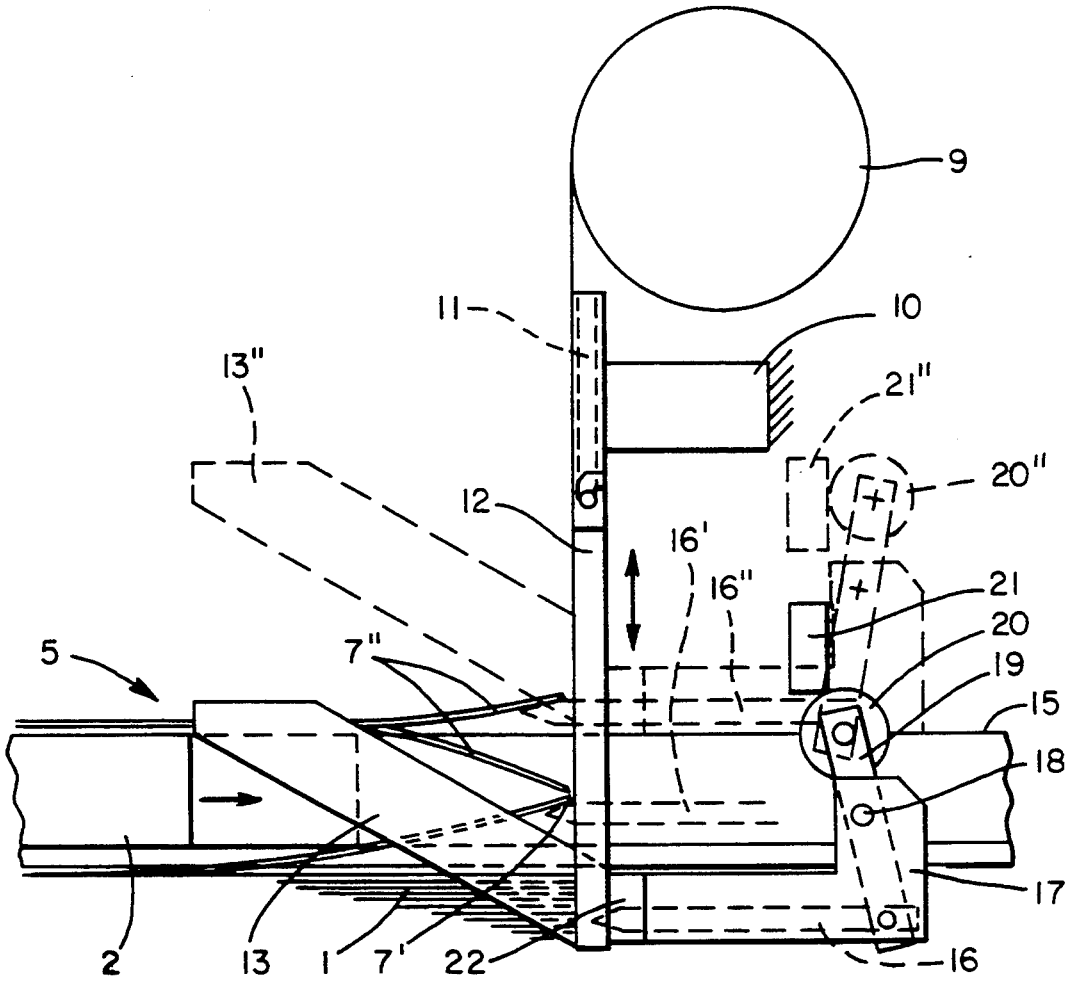
FIG. 3 shows an enlarge, partial side view of the rear stack stop, with dash lines illustrating alternate portions.

In further accordance with the invention, a plurality of spring-loaded rear sheet retention devices 16 are arranged in spaced-apart relation to one another on the carrier 22 by means of similarly spaced angle or L-shaped mountings 17 seen most clearly in FIG. 3. Arranged on each mounting 17 is a rotary joint 18 which is coupled to a lever 19 and the lever 19 is articulated at one end on the sheet retention device 16 and at its other end carries a rotatably mounted roller 20. The roller 20 is designed to engage the already described cross bar 21 which acts as a cam member.

The mode of operation of the invention is as follows: In a conventional manner, the sheets 7 are guided in the conveying direction 22 over a sheet brake 9 by the gripper system 6, which is articulated on a chain system 8, and are deposited on a main stack 1. The main stack 1 rests on a depositing table (not shown) which can be lowered in a known manner according to the increasing stack height. When the main stack 1 has reached its predetermined height, an auxiliary stack 5 is formed, with the production run continuing (at maximum machine speed), so that the main stack 1 can be transported away out of the delivery region.

To form the auxiliary stack 5, the front retention devices 4 are moved, prior to the introduction of the empty stack board 2, into a position which will support the front edge of the sheets 7 being transported by the gripper system 6 (FIG. 1). This creates an open space or gap between the top edge of the main stack 1 and the bottom edge of the auxiliary stack 5 for the introduction of the empty stack board 2 in the direction opposite to the conveying direction 22 and towards the rear stack stops 11, 12. When the stack board 2 sliding in angle rails 15 engages the upwardly obliquely directed wedges 13, the wedges are moved vertically upwards together with the carrier 22 and the L-shaped mountings 17. Therefore, the lower stack stops 12 are also moved vertically upwards. This movement is between a lower position, shown in FIG. 3 by the position of the wedges bearing reference numeral 13, and an upper position shown by the same wedges at 13''. The carrier 22 and other attached components similarly move between lower and upper positions. The rear sheet retention devices 16, arranged underneath the stack board 2 and coupled to the lower stack stops 12, are moved into the delivery region by virtue of the vertical movement of carrier 22. The inward movement takes place in that, during the vertical movement of the angled or L-shaped mounting 17, the roller 20, rotatable on the lever 19, butts against the cross bar 21 acting as a cam member. Thus, via the rotary joint 18, a deflection of the lever 19 and therefore the inward translation of the rear retention devices 16 are respectively brought about. Each retention device 16 remains in its horizontal arrangement and additionally moves vertically. The law of motion of the retention devices 16 is such that these move into the region of the sheet to be deposited and exact separation of the main stack 1 and auxiliary stack 5 takes place simultaneously.

By way of further explanation, the following sequence occurs. At the start of the inward movement of the retention devices 16, the uppermost sheets 7 of the main stack 1 briefly rest on the tips of the retention device 16 and thereafter, during the upward movement of the retention devices 16, are deposited onto the main stack 1. The intermediate position 16' shown in FIG. 3 shows the retention device 16 just after this leafing through operation. Subsequently, the tips of the retention device 16 support the bottommost sheet 7 of the auxiliary stack 5, so that the stack board 2 can be pushed through under the rear lower stack stops 12. The lower stack stops 12 then rest on the stack board 2 and thus prevent sheets 7 from slipping back in the direction of the sheet feeding.

When the auxiliary stack 5 is lowered according to the increasing stack height, the carrier 22 and the wedges 13, the lower stack stops 12 and the rear sheet retention devices 16 together with the lever 19 and roller 20 move downwards. At the same time, the spring-loaded rear retention devices 16 are moved back out of the stack region. The main stack 1 has been transported away in the meantime, and the depositing table is moved on roller chains into the upper initial position and receives the stack board 2 with the auxiliary stack 5. The main and auxiliary stacks 1, 5 preferably have separate drives. During the lifting out of the auxiliary stack 5, the angle rails 15 pivot laterally outwards and move into a retracted position to allow the stack board to move downwardly to carry the new main stack 1.

Depending on the design of the apparatus according to the invention, a plurality of spring elements (tension springs) can be arranged between the cross member 10 and carrier 22 in order to assist the relative movement of the lower stops 12 in relation to the upper stops 11. In addition to assistance by mechanical actuating means, the use of pneumatic working cylinders or of similar means is also possible in a similar way. Thus, a working cylinder can be coupled to sensors which are activated when the stack board/rake is pushed in.

To increase the rigidity of the apparatus according to the invention, the coupling of the cross member 10, cross bar 21 and carrier 22 can take place via coupling members connected by means of joints on both sides (the side facing and the side facing away from the stack region).

What is claimed:

1. An apparatus for auxiliary stack formation in a sheet-delivery machine, having front and stationary rear upper stops and a front sheet-retaining device selectively operable to retain the front edges of sheets in the auxiliary stack, thereby providing a gap between the auxiliary stack and the main stack, the auxiliary stack forming apparatus comprising, in combination:

a stack board for receiving sheets, said stack board being moveable rearwardly relative to the sheet delivery direction in said gap in a horizontal plane above the main stack, the stack board receiving the sheets forming the auxiliary stack, and said stack board and the auxiliary stack being lowerable to subsequently become the main stack;

a set of spaced-apart lower rear stops mounted on a horizontally disposed carrier, said carrier being vertically moveable relative to said stationary rear upper stops, between a lower position wherein the lower stops extend beneath the horizontal plane and a upper position wherein the lower stops are above the horizontal plane for preventing rearward movement of the auxiliary stack sheets;

actuating means mounted on the carrier, engageable by said advancing stack board for moving said carrier between said lower and upper positions; and a plurality of rear sheet retention devices disposed horizontally in spaced-apart relation and mounted on the carrier for movement between a recessed position behind said rear stops, and a sheet retention position for receiving the rear edges of the auxiliary sheets, said rear sheet retention devices being coupled to mounting and guide means for combined horizontal and vertical movement between the positions as the carrier moves between the lower and upper positions;

whereby the auxiliary stack is smoothly removed from the main stack by the combined vertical and horizontal motion of the rear sheet retention devices leafing through the rear edges of the sheets of the main stack until the rear edge of the bottommost sheet of the auxiliary stack is retained and translated upward.

2. An auxiliary stack separating apparatus as defined in claim 1 including a plurality of angle brackets and wherein said stack board is received in said angle brackets disposed horizontally beyond the width of the main stack, to guide the stack board in movement in horizontal plane, the angle brackets being pivotally mounted such that they may pivot to allow downward vertical movement of the stack board.

3. An auxiliary stack separating apparatus as defined in claim 1, including a cross member and a bolt and wherein said stationary rear upper stops are fixed to said cross member, and said bolt is fixed to at least one lower rear stop and at least one upper stop includes a vertical groove, said bolt being received in a vertical groove in said upper stop for guiding said carrier in its vertical movement.

4. An auxiliary stack separating apparatus as defined in claim 3, including a two crank mechanism and wherein a horizontal cross bar is disposed between said cross member and said carrier, said cross bar being operatively connected to said cross member and carrier by said two crank mechanism, and said two crank mechanism providing a lost motion connection such that the motion of said carrier between the two positions only causes vertical movement of said cross bar during a terminal portion of the movement.

5. An auxiliary stack separating apparatus as defined in claim 4, including a roller and wherein said mounting and guide means includes an angled mounting and a lever pivotally mounted within the angled mounting, one end of said lever being pivotally mounted to said horizontally disposed rear sheet retention device, the other end being mounted to said roller and said roller engaging said cross bar during the upward vertical movement of said carrier, the cross bar providing a camming surface for the roller, whereby said lever pivots to actuate said rear sheet retention device from the recessed position to the sheet retention position.

6. An auxiliary stack separating apparatus as defined in claim 1, wherein the actuating means comprise wedges mounted at opposite sides of the carrier, said wedges including camming surfaces which extend downwardly beneath the horizontal plane when the carrier is in the lower position, and said camming surfaces being engaged by said advancing stack board to vertically move said carrier to the upper position.

7. A method of separating main and auxiliary stacks of sheets in a sheet delivery machine including front stops for stopping sheets moving in a delivery direction, stationary upper and movable lower rear stops, front and rear sheet retention devices wherein the rear sheet retention devices are normally disposed below the top of the main stack, and a stack board for accumulating the auxiliary stack, the method comprising the steps of:

actuating front sheet retention devices to support and accumulate the front edges of sheets forming the auxiliary stack and to create a gap between the auxiliary stack and the main stack;

advancing a stack board into the gap in a horizontal direction opposite to the sheet delivery direction;

raising the lower rear stops in response to the advancing stack board to prevent sheets in the auxiliary stack from slipping back into the machine;

actuating the rear sheet retention devices in response to the raising of the lower rear stops, said actuation causing the retention devices to move horizontally toward the front and vertically upwardly such that the rear retention devices leaf through the top sheets of the main stack by sequentially engaging and releasing the rear edges thereof;

separating the bottommost sheet of the auxiliary stack from the main stack by continuing the vertical motion of the rear sheet retention devices in response to the raising of the rear stops; and thereafter accumulating the rear edges of the sheets forming the auxiliary stack on the rear sheet retention devices and bottommost sheet of the auxiliary stack while the main stack is moved away from beneath the auxiliary stack.

8. The method of stack separating according to claim 7, wherein the stack board is supported in a horizontal plane during the time the main stack is moved away and the auxiliary stack is formed, the stack board being subsequently released from the horizontal support so that the stack board is lowered and the auxiliary stack becomes the main stack.

* * * * *